US007850049B2

(12) United States Patent
Ciavarella et al.

(10) Patent No.: US 7,850,049 B2
(45) Date of Patent: Dec. 14, 2010

(54) FOAM PUMP WITH IMPROVED PISTON STRUCTURE

(75) Inventors: Nick E. Ciavarella, Seven Hills, OH (US); David D. Hayes, Wooster, OH (US)

(73) Assignee: GOJO Industries, Inc., Akron, OH (US)

( * ) Notice: Subject to any disclaimer, the term of this patent is extended or adjusted under 35 U.S.C. 154(b) by 486 days.

(21) Appl. No.: 12/011,155

(22) Filed: Jan. 24, 2008

(65) Prior Publication Data

US 2009/0188944 A1 Jul. 30, 2009

(51) Int. Cl.
*B67D 7/76* (2010.01)

(52) U.S. Cl. ..... 222/190; 222/321.7

(58) Field of Classification Search ..... 222/190, 222/145.5, 145.6, 137, 189.11, 231.7, 231.9, 222/321.7, 321.9
See application file for complete search history.

(56) References Cited

U.S. PATENT DOCUMENTS

| | | | | | |
|---|---|---|---|---|---|
| 5,271,530 | A | | 12/1993 | Uehira et al. | |
| 5,445,288 | A | | 8/1995 | Banks | |
| 5,462,208 | A | * | 10/1995 | Stahley et al. | 222/207 |
| 5,570,819 | A | * | 11/1996 | Uehira et al. | 222/190 |
| 5,823,394 | A | * | 10/1998 | Davis et al. | 222/137 |
| 7,147,133 | B2 | * | 12/2006 | Brouwer et al. | 222/145.5 |
| 7,588,170 | B2 | * | 9/2009 | van der Heijden | 222/137 |
| 7,717,301 | B2 | * | 5/2010 | Tsai | 222/190 |
| 7,726,518 | B2 | * | 6/2010 | Brouwer | 222/145.6 |
| 2005/0115988 | A1 | * | 6/2005 | Law et al. | 222/145.5 |
| 2005/0224519 | A1 | | 10/2005 | Law et al. | |
| 2007/0119864 | A1 | * | 5/2007 | Tsai | 222/137 |
| 2007/0215643 | A1 | | 9/2007 | Law et al. | |
| 2009/0008412 | A1 | * | 1/2009 | Choi et al. | 222/190 |
| 2009/0039110 | A1 | * | 2/2009 | Brouwer | 222/190 |
| 2009/0206109 | A1 | * | 8/2009 | Santagiuliana | 222/190 |

* cited by examiner

*Primary Examiner*—Lien T Ngo
(74) *Attorney, Agent, or Firm*—Renner, Kenner, Greive, Bobak, Taylor & Weber

(57) ABSTRACT

A foam pump includes a piston housing and a piston assembly received in the piston housing thereby defining a collapsible liquid chamber and a collapsible air chamber. The piston assembly includes a premix chamber separated from both the collapsible liquid chamber and the collapsible air chamber by a premix chamber wall and fluidly communicating with both the collapsible liquid chamber and the collapsible air chamber through a mix aperture in the premix chamber wall. A biasing member urges the piston assembly to a non-actuated position. The foam pump is actuated by urging the piston assembly against the biasing member to an actuated position in which the collapsible air chamber and the collapsible liquid chamber are reduced in volume such that air and foamable liquid are expelled from their respective collapsible air chamber and collapsible liquid chamber through the mix aperture. The simultaneous movement of the air and foamable liquid through the mix aperture causes a turbulent mixing thereof.

6 Claims, 2 Drawing Sheets

FOAM PUMP WITH IMPROVED PISTON STRUCTURE

TECHNICAL FIELD

The invention herein resides in the art of foam pumps, wherein a foamable liquid and air are combined to create a foam product. More particularly, the invention relates to a piston pump wherein a liquid piston portion and an air piston portion are provided as part of a piston assembly that is received by a piston housing for reciprocal movement with respect to the housing.

BACKGROUND OF THE INVENTION

For many years, liquids, such as soaps, sanitizers, cleansers, disinfectants, and the like have been dispensed through the use of user-actuated pumps. The pump mechanism employed with such dispensers has typically been a liquid pump, simply emitting a predetermined quantity of the liquid upon movement of an actuator. Recently, for purposes of effectiveness and economy, it has become desirable to dispense the liquids in the form of foam, generated by the interjection of air into the liquid. Accordingly, the standard liquid pump has given way to a foam generating pump, which necessarily requires means for combining the air and liquid in such a manner as to generate the desired foam.

Typically, foam pumps include an air pump portion and a fluid pump portion—the two requiring communication to ultimately create the foam. One type of foam pump, such as those shown in U.S. Pat. Nos. 5,271,530 and 5,445,288, employs air and liquid pistons that move within respective air and liquid piston housings and employ valves to drawn air and liquid from separate sources and direct them into a common chamber and/or through a screen member to create a foam product. This invention improves upon such piston-based dispensers.

SUMMARY OF THE INVENTION

This invention provides a pump including a piston housing and a piston assembly received in the piston housing thereby defining a collapsible liquid chamber, which contains a foamable liquid, and a collapsible air chamber, which contains air. The piston assembly includes a premix chamber separated from both the collapsible liquid chamber and the collapsible air chamber by a premix chamber wall and fluidly communicating with both the collapsible liquid chamber and the collapsible air chamber through a mix aperture in the premix chamber wall. A biasing member urges the piston assembly to a non-actuated position, and the foam pump is actuated by urging the piston assembly against the biasing member to an actuated position in which the collapsible air chamber and the collapsible liquid chamber are reduced in volume such that air is expelled from the collapsible air chamber and through the mix aperture while at the same time foamable liquid is expelled from the collapsible liquid chamber through the mix aperture, with the simultaneous movement of the air and foamable liquid through the mix aperture causing a turbulent mixing thereof.

In a particular embodiment the piston housing includes a base wall, at least one sidewall extending from the base wall, a liquid tube extending from the base wall interiorly of the at least one sidewall, and an inlet communicating with the liquid tube through the base wall. A liquid valve regulates the flow of foamable liquid through the inlet from a foamable liquid source. The piston assembly includes a liquid piston sealed to the liquid tube of the piston housing to define the collapsible liquid chamber, an air piston sealed to the sidewall of the piston housing to define the collapsible air chamber. The liquid piston is positioned in the collapsible air chamber and secured to the air piston to move therewith.

DETAILED DESCRIPTION OF THE INVENTION

Figure 1:
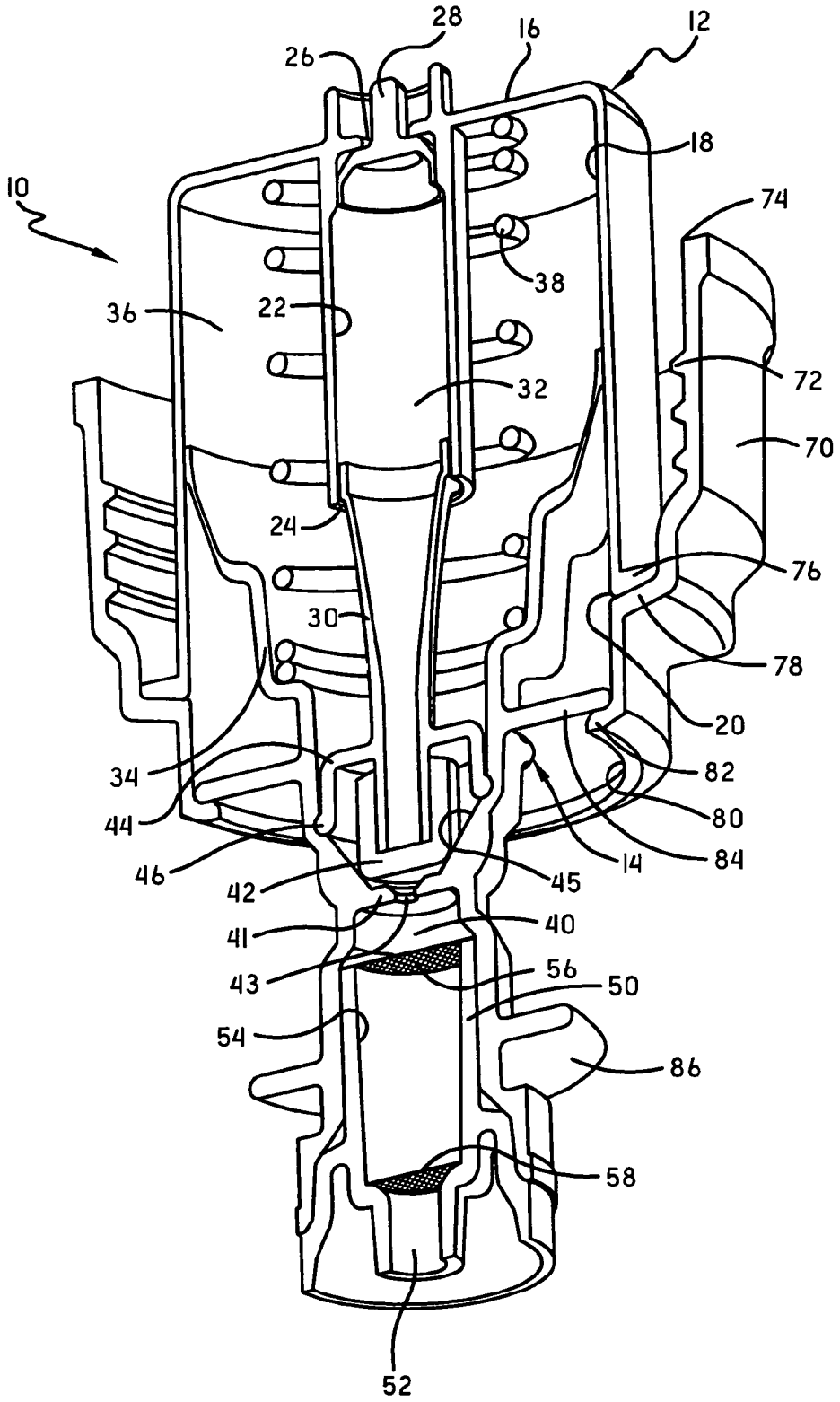
FIG. 1 is a cross sectional view of an embodiment of a foam pump of this invention, shown in a non-actuated position.

With reference to FIG. 1, a foam pump in accordance with this invention is shown and designated by the numeral 10. The pump 10 is formed of a piston housing 12 and a piston assembly 14. The piston housing 12 includes a base wall 16 and at least one sidewall 18 extending from the base wall 16 to an open end 20. A liquid tube 22 extends from the basewall 16 interiorly of the at least one and sidewall 18 to an open end 24, and an inlet 26 communicates with the liquid tube 22 through the base wall 16. A liquid valve 28 regulates the flow of fluid through the inlet 26, permitting fluid to flow through the inlet 26 into the liquid tube 22 and preventing fluid flow from inside liquid 22 through inlet 26. A source of foamable liquid (not shown) would fluidly communicate with inlet 26, so that the foamable liquid can be drawn into and expelled from the foam pump 10 to be dispensed thereby.

The piston assembly includes a liquid piston 30, which is sealed to the liquid tube 22 of the piston housing 12 to define a collapsible liquid chamber 32, and an air piston 34, which is sealed to the at least one sidewall 18 of the piston housing 12 to define a collapsible air chamber 36. As seen, the liquid piston 30 is positioned in the collapsible air chamber 36 and secured to the air piston 34 to move therewith. A biasing member 38 urges the liquid piston 30 to a non actuated position, which is shown FIG. 1. The biasing member could be positioned elsewhere, and need not take the form of a spring positioned in the collapsible air chamber 36, as here. A premix chamber 40 is separated from both the collapsible liquid chamber 32 and the collapsible air chamber 36 by a premix chamber wall 41, and fluidly communicates with the collapsible liquid chamber 32 and the collapsible air chamber 36 through a mix aperture 43 in the premix chamber wall 41. A liquid outlet valve 42 regulates the flow of foamable liquid out of the collapsible liquid chamber, as will be described below.

A bracket 44 extends from liquid piston 30 to secure the liquid piston 30 to the interior wall of the air piston 34 at groove 46. A plurality of ribs 45 extend radially and upwardly from the premix chamber wall 41 to form groove 46. As seen in comparison of the different cross sections provided in FIGS. 1 and 2, these ribs 45 are spaced from one another to define air channels 48, which permit the passage of air past the bracket 44 and toward and through the mix aperture 43 into the premix chamber 40. A mixing cartridge 50 is positioned between the premix chamber 40 and the pump outlet 52. The mixing cartridge 50 includes a tube 54 bounded by an inlet mesh 56 and an outlet mesh 58. The inlet mesh 56 is spaced from aperture 53 to thereby define the size of the premix chamber 40. The outlet mesh 58 is positioned approximate the pump outlet 52. It should be appreciated that the mixing cartridge provides opposed meshes and creates a high quality foam product, but a single mesh could be employed instead, at the position of inlet mesh 56, thus still defining the desired premix chamber 40 between the single mesh and the mix aperture 43.

Figure 2:
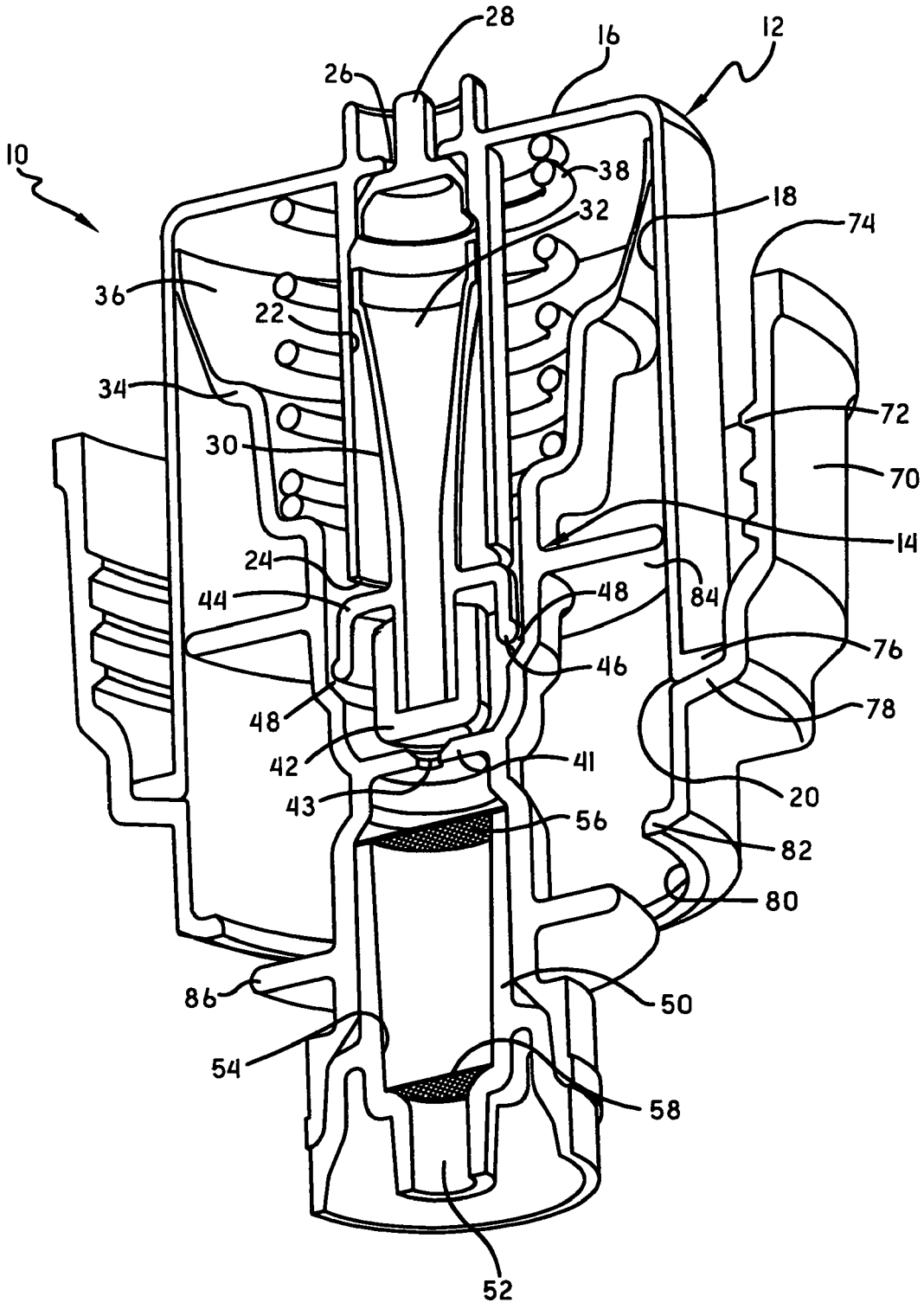
FIG. 2 is a cross sectional view as in FIG. 1, but shown with the pump in an actuated position and with the cross section taken through a different plane to show the ribs that help secure the liquid piston.

The foam pump 10 is actuated by urging the piston assembly 14 against the biasing member 38 to an actuated position as shown in FIG. 2. As seen, this reduces the volume of both the collapsible air chamber 36 and the collapsible liquid chamber 32, and, as a result, air is expelled from the collapsible air chamber 36, through the mix aperture 43, while at the same time foamable liquid is expelled from the collapsible liquid chamber 32 through the mix aperture 43. The air is advanced through the air channels 48 defined between neighboring ribs 45. The liquid outlet valve 42 is a cup-shaped elastomeric piece covering the outlet 59 of the liquid piston 30, and it deforms to under the pressure of the liquid being force from the collapsible liquid chamber 32 to allow liquid to pass between the liquid outlet valve 42 and the piston 30. The liquid is ultimately advanced through the liquid outlet valve 42. Thus, it can be seen that the foamable liquid and air come into contact above the mix aperture 43 and are simultaneously forced through the mix aperture 43. This simultaneous movement of a significant volume of air and foamable liquid through the small passage provided by mix aperture 43 causes a turbulent mixing of the air and foamable liquid to create a coarse foam mixture. The coarse foam mixture is advanced through the mixing cartridge 50 to create a uniform, high quality foam product that is dispensed at pump outlet 52. The biasing member 38 returns the piston assembly 14 to the non-actuated position of FIG. 1, and the collapsible liquid chamber 32 expands, drawing liquid in through liquid valve 28. Similarly, the collapsible air chamber 36 expands, drawing air back up through the pump outlet 52, the mixing cartridge 50, the premix chamber 40, the mix aperture 43 and past the bracket 44. This creates a back suction that draws foamable liquid back into the pump to prevent or reduce dripping, particularly when this pump 10 is employed in the inverted position shown. The collapsible air chamber 36 may receive some foamable liquid drawn up through the air channels 48. The liquid outlet valve 42 prevents air from entering the collapsible liquid chamber 32.

In this particular embodiment, a cap member 70 is provided to secure the foam pump 10 to a bottle neck (not shown), as generally known. Threads 72 accessible through open end 74 interact with threads on a bottle neck, and a radial flange 76 extends from the open end 20 of the pump housing 12 to secure to a flange mount 78 in cap member 70. At open end 80, a radial flange 82 extends inwardly to interact with a radial flange 84 extending from the exterior of the collapsible air chamber 36. The pump housing 12 is secured, while the piston assembly 14 can move relative thereto, though limited by radial flange 82. An actuation flange 86 can be provided on piston assembly 14 for engagement by a dispenser element to pushing on the piston assembly 14 against the biasing member 38.

The ratio of air to liquid fed to the mixing cartridge 50 can be altered by altering the size of the collapsible air chamber 36 and collapsible liquid chamber 32. In particular embodiments the collapsible air chamber 36 and collapsible liquid chamber 32 are designed so that the ratio of the volume of air to the volume of liquid fed to the mixing chamber is about 10:1.

In light of the forgoing, it should be evident that this invention provides improvements in the art of foam pumps. While only particularly desired embodiments have been described herein in accordance with disclosure requirements, it should be appreciated that structural aspects of this invention might be altered and yet be considered within the scope of this invention, which will be defined by the claims herein.

The invention claimed is:

1. A foam pump comprising:

(a) a piston housing including (i) a base wall, (ii) at least one sidewall extending from said base wall, (iii) a liquid tube extending from said base wall interiorly of said at least one sidewall, (iv) an inlet communicating with said liquid tube through said base wall; and (v) a liquid inlet valve regulating flow through said inlet;

(b) a piston assembly received in said piston housing, said piston assembly including (i) a liquid piston sealed to said liquid tube of said piston housing to define a collapsible liquid chamber containing a foamable liquid, and (ii) an air piston sealed to said sidewall of said piston housing to define a collapsible air chamber containing air, said liquid piston being positioned in said collapsible air chamber and secured to said air piston to move therewith, said piston assembly including a premix chamber separated from both said collapsible liquid chamber and said collapsible air chamber by a premix chamber wall and fluidly communicating with both said collapsible liquid chamber and said collapsible air chamber through a mix aperture in said premix chamber wall, (c) a biasing member urging said piston assembly to a non-actuated position, wherein the foam pump is actuated by urging said piston assembly against said biasing member to an actuated position in which said collapsible air chamber and said collapsible liquid chamber are reduced in volume such that air is expelled from said collapsible air chamber and through said mix aperture while at the same time foamable liquid is expelled from said collapsible liquid chamber through said mix aperture, with the simultaneous movement of said air and foamable liquid through said mix aperture causing a turbulent mixing thereof into said premix chamber the foam pump characterized in that said air piston includes ribs spaced from one another, and said liquid piston includes a bracket extending to secure said liquid piston to said air piston at said ribs such that the spacing between the ribs provides air channels that permit the passage of air past said bracket and toward said mix aperture.

2. The foam pump of claim 1, further comprising a liquid outlet valve regulating the flow of liquid out of said collapsible liquid chamber.

3. The foam pump of claim 1, further comprising a mixing mesh positioned downstream of said premix chamber, such that, during actuation of the foam pump, said air and foamable liquid mixed in said premix chamber are forced through said mixing mesh.

4. The foam pump of claim 3, wherein said mixing mesh is part of a mixing cartridge having a hollow tube bounded on an inlet end by said mixing mesh and on an outlet end by an outlet mixing mesh.

5. The foam pump of claim 1, wherein said biasing member is positioned in said collapsible air chamber.

6. The foam pump of claim 5, wherein said biasing member is a spring.

* * * * *